US005239941A

United States Patent [19]

Chibi

[11] Patent Number: 5,239,941

[45] Date of Patent: Aug. 31, 1993

[54] BRAKING SYSTEM FOR IN-LINE ROLLER SKATES

[76] Inventor: Gary Chibi, 4025 Nootka Street, Vancouver, British Columbia, Canada, V5R 2E1

[21] Appl. No.: 919,229

[22] Filed: Jul. 27, 1992

[51] Int. Cl.[5] ..... A63C 17/14

[52] U.S. Cl. ..... 74/502.2; 280/11.2; 280/11.22; 188/2 D

[58] Field of Search ..... 74/502.2; 280/11.2, 280/11.22; 188/72.1, 2 D, 71.5, 24.22

[56] References Cited

U.S. PATENT DOCUMENTS

| | | | |
|---|---|---|---|
| 1,371,623 | 3/1921 | Ickenroth | 280/11.2 |
| 3,904,215 | 9/1975 | Bardy | 280/11.2 |
| 4,076,266 | 2/1978 | Krausz | 280/11.2 X |
| 4,183,546 | 1/1980 | Heilig | 280/11.2 X |
| 4,674,353 | 6/1987 | Yoshigai | 74/502.2 X |
| 4,805,936 | 2/1989 | Krantz | 280/11.2 X |
| 4,943,075 | 7/1990 | Gates | 280/11.2 X |
| 5,106,110 | 4/1992 | Williamson | 280/11.2 |
| 5,143,387 | 9/1992 | Colla | 280/11.22 X |
| 5,171,032 | 12/1992 | Dettmer | 280/11.22 X |

FOREIGN PATENT DOCUMENTS

| | | | |
|---|---|---|---|
| 2632555 | 2/1978 | Fed. Rep. of Germany | 280/11.2 |
| 2627995 | 9/1989 | France | 280/11.2 |
| 301363 | 10/1932 | Italy | 280/11.2 |
| 651868 | 4/1951 | United Kingdom | 280/11.2 |

*Primary Examiner*—Rodney H. Bonck
*Assistant Examiner*—Ryan W. Massey
*Attorney, Agent, or Firm*—Pascal & Associates

[57] ABSTRACT

A brake mechanism for a roller blade having at least a pair of in-line wheels each suspended via an axle from a pair of frame members disposed on opposite sides of the wheels, comprised of two pair of disk shaped bearing surfaces, each pair fixed to opposite sides of a corresponding wheel coaxial with its axle, a pair of brake pad supports, each on an opposite side of the wheels, each having opposite end regions overlapping the bearing surfaces on both wheels, brake pads retained by the brake pad supports between the end regions of the brake pad supports and the bearing surfaces, apparatus for resiliently retaining the brake pad supports in positions with the brake pads spaced from the bearing surfaces, remote control apparatus for squeezing the brake pad supports together whereby the brake pads bear against the bearing surfaces, increasing friction therebetween and retarding rotation of the wheels.

18 Claims, 4 Drawing Sheets

BRAKING SYSTEM FOR IN-LINE ROLLER SKATES

FIELD OF THE INVENTION

This invention relates to roller skates, and particularly to a brake mechanism for a type of roller skate commonly referred to as a roller blade.

BACKGROUND TO THE INVENTION

A type of roller skate has recently become very popular which is comprised of typically four in-line wheels retained on a frame, on which a boot or shoe retaining platform is supported, and is commonly referred to as a roller blade. In order to provide increased control to the user, a brake for each roller blade is a desirable accessory. Typically such a brake is comprised of a pad which extends diagonally outwardly from the back of the frame, which the user forces into engagement with a skating surface such as a road or sidewalk by tilting the roller blade. This type of brake has been found to be inadequate for use during high speed or on hills, and many accidents have occurred.

There are many other examples of braking systems for roller skates that have been designed.

In U.S. Pat. No. 4,943,075 to Gates, a remote manually controlled cable operated structure is described which uses a bicycle-type caliper brake against the wheel of a tire-type skate roller. Unfortunately this type of brake is unsuitable for use with modern roller blade type skates for several reasons. Firstly the form of the caliper would interfere with the frame of a roller blade. Secondly there is insufficient room between the frame and the roller of modern roller blades to accommodate the brake pads and their supporting mechanisms. Thirdly, due to the structure of the bicycle type caliper mechanism, it is unsuitable for use with a tire type roller which is not supported by a separate wheel, i.e. one which is made of a composition which merely supports a central bushing and axle, as is the case with a modern roller blade wheel. Fourthly, the caliper type mechanism is suitable only to brake one wheel.

U.S. Pat. No. 4,300,781 to Riggs describes a braking mechanism for the traditional type of four wheel roller skate in which a pair of wheels is supported on each of two axles. A brake pad is caused to engage with the same surfaces of the rollers which contact the skating surface. Unfortunately such structures are not suitable for use with roller blades, because a roller blade wheel has a much narrower region which such a brake may contact, decreasing its efficiency and increasing risk. The skating surface contacting portion of the roller blade is typically oval or nearly oval, and changes with wear, which would complicate the required surface profile of the brake pad. In addition, the roller blade rollers often pit during use and pick up dirt, which would substantially increase wear on the brake pads if the Riggs structure were used. This could result in a dangerous condition if the brake was used at high speeds.

U.S. Pat. No. 4,805,936 to Krantz describes a complex caliper brake mechanism which suffers from many of the deficiencies of the Gates design, in a wheeled ski.

U.S. Pat. No. 4,108,451 to Scheck, Sr. describes a brake mechanism which uses a disk mounted to the side of the wheel, which is engaged by a brake. This is a complex and costly structure, and impedes use of the skate where the skate is to be tilted relative to the skating surface, which is often the case during use of roller blades.

U.S. Pat. No. 1,628,004 to Stetson illustrates an entirely different type of braking structure which utilizes a gear which rotates a wheel which itself is braked by a brake band. In order to accommodate the gear, the entire structure requires the use of large pairs of oppositely disposed rollers. It is clearly unsuitable for use with a modern roller blade.

U.S. Pat. No. 1,801,205 to Mirick describes a roller blade having brake pads which bear against the outside rolling surfaces of a pair of wheels. With sufficient use of this brake, the braked wheels wear faster than the other wheels, requiring replacement. The replacement wheels, being new, would likely be larger than the remaining wheels, causing a dangerous operating condition. Accordingly once the braked wheels have been worn, all wheels must be replaced, which is expensive.

U.S. Pat. No. 5,106,110 to Williamson, describes a unicycle roller skate which uses a bicycle type caliper brake mechanism. This has many of the same deficiencies as the above-described Gates structure when used on a multi-wheeled roller blade.

SUMMARY OF THE INVENTION

The present invention is a brake mechanism for a roller blade which is usefully integrated efficiently into a modern type roller blade, and in accordance with one embodiment, can be added as an accessory to an existing roller blade, wherein the rollers of the roller blade are of single composition of the type that retain an axle passing directly through the wheel or a bushing.

The brake pads do not bear against the rolling surface of the wheel. As a result operation of the brake does not wear down the diameter of the wheel. Both the brake pads and disks against which the brake pads preferably wear are easily replaceable.

In addition, the present invention can be used to lock the brakes against the rollers, whereby the roller blades can be used to climb stairs or to climb a hill.

In accordance with an embodiment of the invention, a brake mechanism for a roller blade having at least a pair of in-line wheels each suspended via an axle from a pair of frame members disposed on opposite sides of the wheels is comprised of two pair of disk shaped bearing surfaces, each pair fixed to opposite sides of a corresponding wheel, coaxial with its axle, a pair of brake pad supports, each on an opposite side of the wheels, each having opposite end regions overlapping the bearing surfaces on both wheels, brake pads retained by the brake pad supports between the end regions of the brake pad supports and the bearing surfaces, apparatus for resiliently retaining the brake pad supports in positions with the brake pads spaced from the bearing surfaces, and remote control apparatus for squeezing the brake pad supports together whereby the brake pads bear against the bearing surfaces, increasing friction therebetween and retarding rotation of the wheels.

According to another embodiment, the frame members each contain a slot along the axis thereof, the brake pad supports being contained within the slots.

In accordance with another embodiment, the brake pad supports are resiliently fastened to the frame members, the brake pads being located below the frame members.

In accordance with another embodiment, the remote control apparatus is a control cable comprised of flexible shaft surrounded by a sheath, the sheath comprising first bearing apparatus for bearing against one of the brake pad supports, the shaft comprising second bearing apparatus for pulling against the other of the brake pad supports in an opposite direction whereby the brake pad supports are drawn together, the other end of the sheath being connected to a handle, the shaft being connected to a lever pivoted on the handle, whereby squeezing the lever toward the handle transfers tension and pressure to the brake pad supports, pulling them and the brake pads together against both sides of both wheels.

In order to lock the brake, a brake locking mechanism for retaining relative positions of the cable and the sheath is utilized and is comprised of a pin extending from either one of the handle or lever, and a hook rotationally pinned to the other of the handle or lever in a position such that when the handle and lever are squeezed together, the hook can be rotated over the pin and lock the handle and lever in the squeezed position.

BRIEF INTRODUCTION TO THE DRAWINGS

A better understanding of the invention will be obtained by reference to the detailed description below, in conjunction with the following drawings, in which:

FIG. 1 is a side view of a roller blade in accordance with an embodiment of the invention, FIG. 1A is, a side view of a wheel of the roller blade, FIG. 2 is a bottom view of the embodiment illustrated in FIG. 1, FIG. 3 is a side view of a second embodiment of the invention, and FIG. 4 is a sectional view of the second embodiment of the invention taken along section A—A of FIG. 3.

DETAILED DESCRIPTION OF THE INVENTION

Figures 1, 1A:
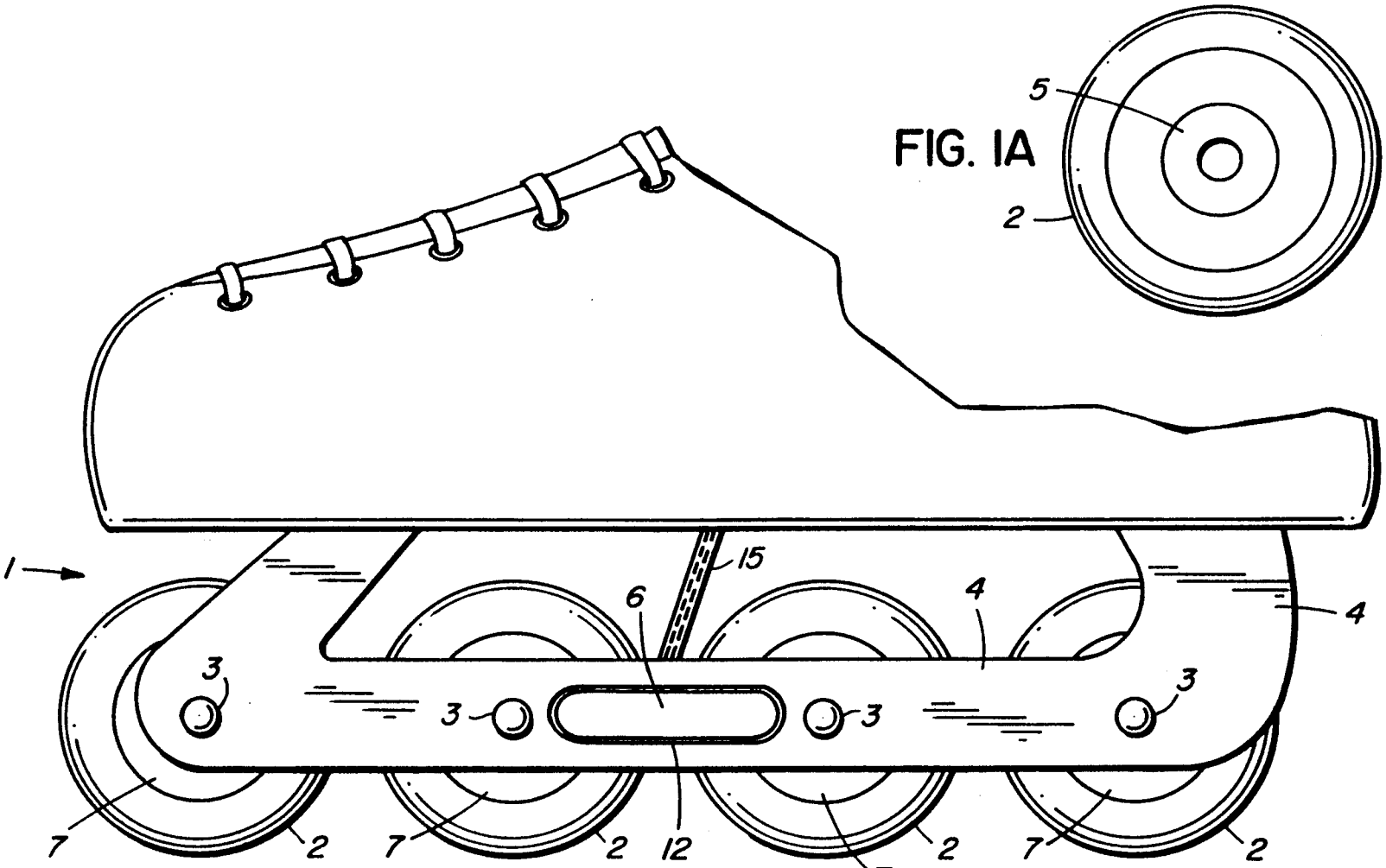
Figure 2:
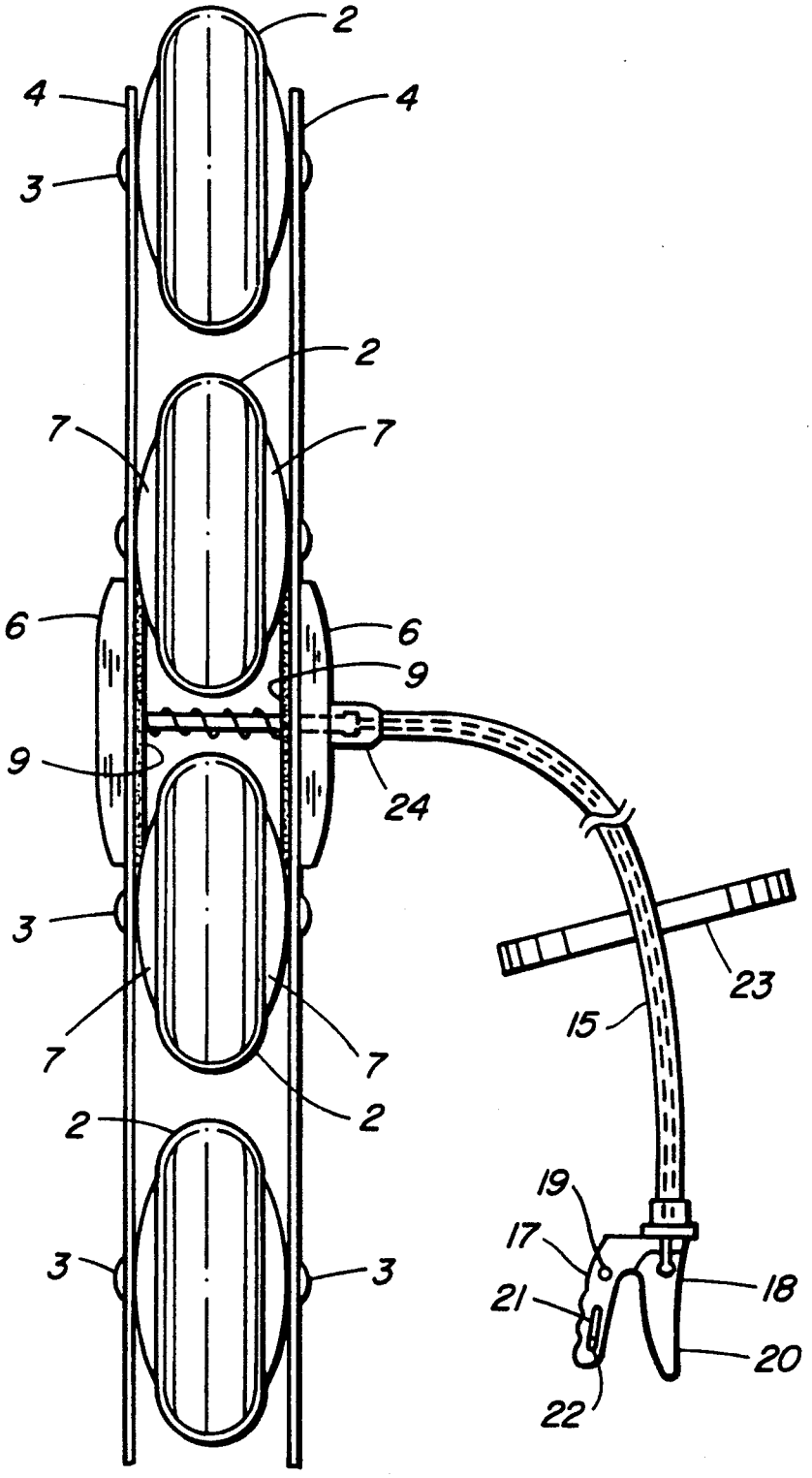

Turning first to FIGS. 1, 1A and 2, a roller blade 1 is comprised of e.g. four wheels 2. The wheels 2 are supported by axles 3 from a pair of frame members 4, which are disposed on opposite sides of the wheels 2. The frame members are shown only in partial cross-section in FIG. 2 in order to make the nature of the invention clearer. As may be seen in FIG. 1A, the wheel is typically formed of dense material and contains an axle bearing 5 molded into the wheel, through which the axle 3 passes.

A pair of brake pad supports 6 are disposed on opposite sides of preferably the two center wheels of the roller blade. Each of those wheels preferably has a metal disk 7 against which the brake can bear fixed to each side, conforming to the profile of the wheel, coaxially with the axle of the wheel. The brake pad supports have opposite end regions 8 which overlap the disks on both wheels.

In order to accommodate the brake pad supports, it is preferred that the frame members 4 should contain slots 12, with the brake pad supports 6 contained therein. The edge of the frames surrounding the brake pad supports should be very rigid, and therefore are preferred to be curled or rolled. A ridge on each of the outer sides of the frame are preferred to be used to prevent the brake pads from passing through.

Brake pads 9 are retained by the brake pad supports between the end regions of the brake pad supports and the disks. The brake pads may of course extend over the entire inside surfaces of the brake pad supports. The brake pad supports are resiliently retained in position with the brake pads spaced from the disks, in this embodiment by a brake pad guide bolt 10 and a compression spring 11 retained around the guide bolt which bears outwardly against the brake pad supports. The guide bolt can be fastened to one brake pad support by means of a screw head passing through that break pad support and threaded into one end of the guide bolt, and the other end of the guide bolt can slide through a hole in the other brake pad support. It will become evident by the description below how the brake pad supports are further retained.

A brake cable sheath 15 has a cap nut 24 fixed to its end which bears against the outside surface of the brake pad support through which guide bolt slides. A flexible shaft 16 which passes through the sheath is fixed to the end of the guide bolt in a well known manner. Thus by pulling the flexible shaft outwardly at the other end relative to the sheath, the brake pad supports and thus the brake pads are pulled toward each other and thus bear against opposite sides of both wheels, exerting braking friction. When the pressure is released, spring 11 separates the brake pad supports, releasing braking friction.

The other end of the sheath is fixed to a handle 17. A control lever 18 is pivoted e.g. at pin 19 to the handle 17, and the flexible shaft 16 extends and is hooked to the lever 18.

Thus when the lever and handle are compressed toward each other, the flexible shaft is pulled relative to the sheath, causing the brake pad supports to be compressed toward each other, thus bearing the brake pads against the disks 7 which are fixed to the wheels 2. The flexible shaft pulls against one brake pad support and the sheath pushes against the other.

A brake lock is provided by means of a pin 20 extending outwardly from handle 18 (orthogonal to the plane of the paper). A hook 21 is rotatably pinned by pin 22 to the handle. When the lever and handle are squeezed together, the hook can be rotated, hooking over pin 20, locking the handle and lever together, retaining brake pressure and allowing the locked roller blade to be used when climbing.

Of course there are other ways in which the lock can be made, e.g. by providing a notch in the control lever on the side adjacent the handle, and hooking the hook into that notch. If the handle contains a channel opposite the control lever, the hook can be retained in that channel, thus avoiding chafing the hands of the user.

While not illustrated in FIG. 2, the cable can be as long as desired, e.g. preferably to waist height or higher of the user. A strap 23 having e.g. a Velcro TM closure can be used to retain the cable and sheath to the arm and/or to the waist and/or leg of the user, keeping the hands and arms free.

Thus by squeezing and locking the brake, a user can climb a hill and have his hands free for balance or other purposes, yet retain the brake actuating handle and lever adjacent his hands.

Figure 3:
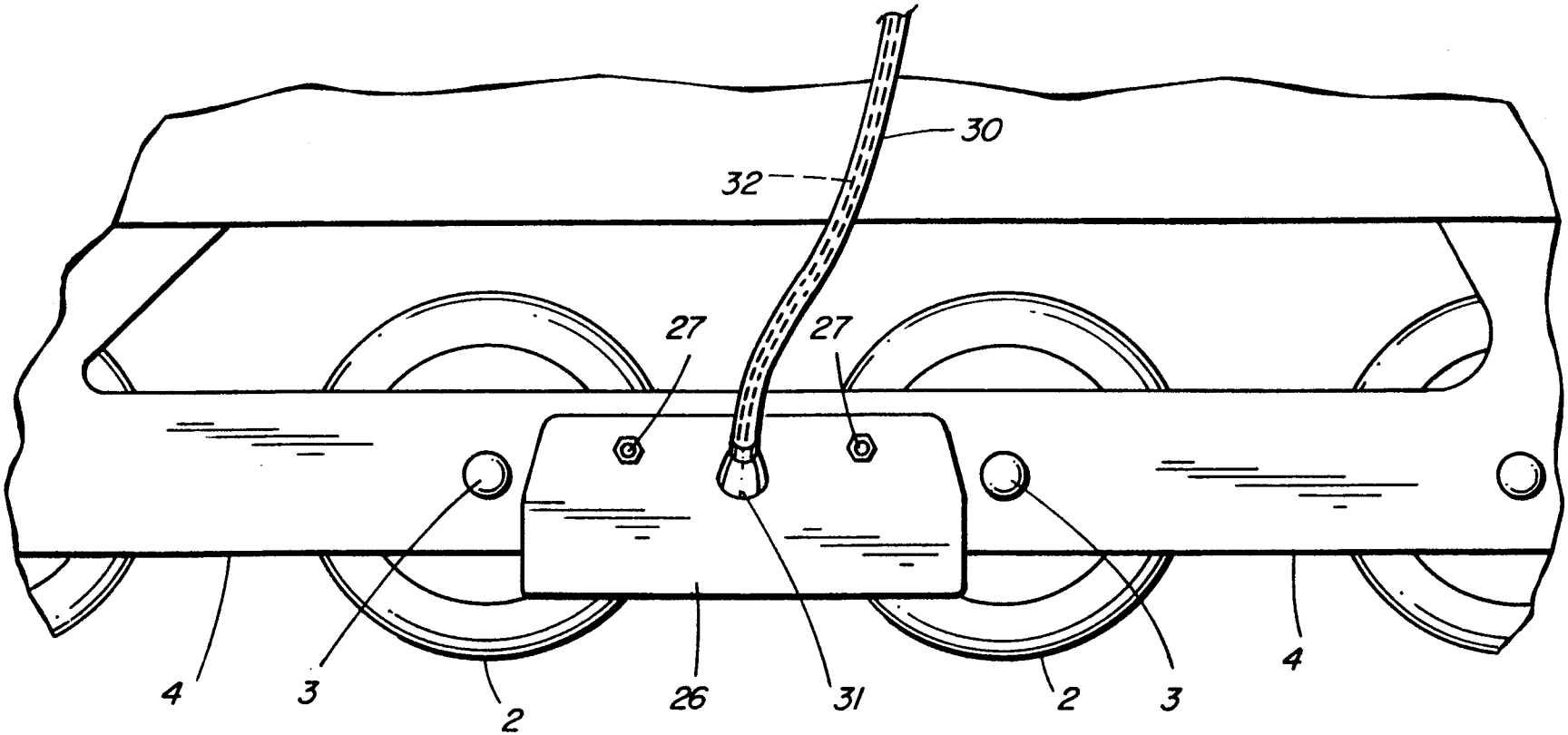
Figure 4:
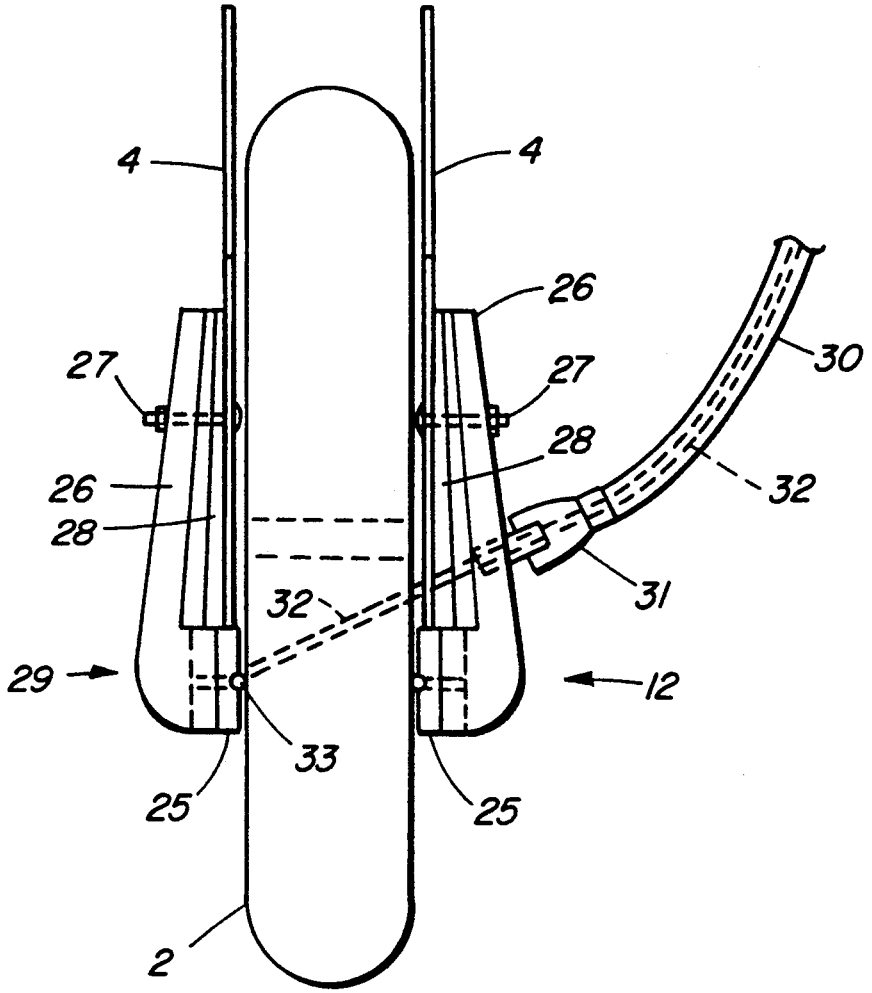

Turning now to FIGS. 3 and 4, another embodiment of the invention is illustrated.

Brake pad supports 26 are resiliently fastened to the outsides of frame members 4 by means of fastening bolts 27. Resilient, preferably rubber wedges 28 are disposed between the brake pad supports and the frames. FIG. 4 being a vertical section A—A of FIG. 3 through the bolt 27, it may be seen that the brake pad supports are turned inwardly toward the wheels as shown at 29 under the frames 4. Brake pads 25 are fixed to the wheel-facing surfaces of the turned portions 29 of the brake pad supports.

In this embodiment, as in the previously described embodiment, the sheath 30 has an end cap nut 31 which bears against the outside of one of the brake pad supports 26. It can be fastened to a threaded tube extending from that brake pad support. Flexible shaft 32 passes through sheath 30 between the wheels 2, and is hooked or otherwise fixed at 33 to the other brake pad support 26.

The wedges 28 can be made of resilient material such as dense foam or rubber which resiliently compresses under pressure.

In operation with the flexible shaft 32 being pulled relative to sheath 30, force is exerted against the brake pad supports 26, which are forced toward each other. The brake pads 25 are thus forced against the disks (not shown in FIG. 4), thus braking rotation of the wheel 2.

In the embodiment of FIG. 4, the position of where pressure is applied against the brake pad support by the sheath is higher than the position where the flexible shaft attaches to the other brake pad support. This results in the flexible shaft and sheath extending at an upward incline from the brake pad supports, rather than extending outwardly parallel to the axis of the roller, which avoids creating sharp angles of the flexible shaft and sheath, which is desirable to avoid snagging and to minimize friction between the flexible shaft and its sheath.

It may be seen that the structure described with reference to FIGS. 3 and 4 may be added to existing roller blade designs, without the necessity of forming slots in the frame members 4.

It is preferred that the brake pads should be formed of a composition of fiber and rubber. However in case a metal brake disk is not used, in some designs, a compact oil soaked felt pad may be used instead as the brake pad material. Therefore it should be recognized that the use of a disk is not an essential element of the invention if the composition of the materials used allows the brake pads to be compressed on disk shaped side bearing surfaces of the rollers themselves.

A person understanding this invention may now conceive of alternative structures and embodiments or variations of the above. All of those which fall within the scope of the claims appended hereto are considered to be part of the present invention.

I claim:

1. A brake mechanism for a roller blade having at least a pair of in-line wheels each suspended via an axle from a pair of frame members disposed on opposite sides of the wheels, comprising:

(a) two pair of disk shaped bearing surfaces, each pair fixed to opposite sides of a corresponding wheel coaxial with its axle, (b) a pair of brake pad supports, each on an opposite side of the wheels, each having opposite end regions overlapping the bearing surfaces on both wheels, (c) brake pads retained by the brake pad supports between the end regions of the brake pad supports and the bearing surfaces, (d) means for resiliently retaining the brake pad supports in positions with the brake pads spaced from the bearing surfaces, (e) remote control means for squeezing the brake pad supports together whereby the brake pads bear against the bearing surfaces, increasing friction therebetween and retarding rotation of the wheels.

2. A brake mechanism as defined in claim 1, in which the frame members each contain a slot along the axis of the frame members, brake pad supports being contained within the slots.

3. A brake mechanism as defined in claim in which the bearing surfaces are comprised of disks fixed against each side of each wheel.

4. A brake mechanism as defined in claim 1, in which the brake pad supports are resiliently fastened to the frame members, the brake pads being located below the frame members.

5. A brake mechanism as defined in claim 1 in which the remote control means is a flexible control cable comprised of a flexible shaft surrounded by a sheath, the sheath comprising first bearing means for bearing against one of the brake pad supports, the shaft comprising second bearing means for pulling against the other of the brake pad supports in an opposite direction whereby the brake pad supports are drawn together, the other end of the sheath being connected to a handle, the flexible shaft being connected to a lever pivoted on the handle, whereby squeezing the lever toward the handle transfers tension and pressure to the brake pad supports, pulling them and the brake pad supports together against both sides of both wheels.

6. A brake mechanism as defined in claim 5, further including a brake locking mechanism for retaining relative positions of the cable and sheath.

7. A brake mechanism as defined in claim 6 in which the locking mechanism is comprised of a pin extending from either one of the handle or lever, and a hook rotatably pinned to the other of the handle and lever in a position such that when the handle and lever are squeezed together, the hook can be rotated over the pin and retain the handle and lever together.

8. A brake mechanism as defined in claim 2 in which the brake pad supports are retained on a guide bolt extending therebetween, and are separated by a compression spring retained around the guide bolt.

9. A brake mechanism as defined in claim 4 including resilient wedges disposed between the brake pad supports and the frame.

10. A brake mechanism as defined in claim 9 in which said wedges are comprised of rubber.

11. A brake mechanism as defined in claim 10 in which the bearing surfaces are comprised of disks fixed against each side of each wheel.

12. A brake mechanism as defined in claim 11 in which the remote control means is a flexible control cable comprised of a flexible shaft surrounded by a sheath, the sheath comprising first bearing means for bearing against one of the brake pad supports, the shaft comprising second bearing means for pulling against the other of the brake pad supports in an opposite direction whereby the brake pad supports are drawn together, the other end of the sheath being connected to a handle, the flexible shaft being connected to a lever pivoted on the handle, whereby squeezing the lever toward the handle transfers tension and pressure to the brake pad supports, pulling them and the brake pad supports together against both sides of both wheels.

13. A brake mechanism as defined in claim 12, further including a brake locking mechanism for retaining relative positions of the cable and sheath.

14. A brake mechanism as defined in claim 13 in which the locking mechanism is comprised of a pin extending from either one of the handle or lever, and a hook rotatably pinned to the other of the handle and lever in a position such that when the handle and lever are squeezed together, the hook can be rotated over the pin and retain the handle and lever together.

15. A brake mechanism as defined in claim 9 in which the bearing surfaces are comprised of disks fixed against each side of each wheel.

16. A brake mechanism as defined in claim 15 in which the remote control means is a flexible control cable comprised of a flexible shaft surrounded by a sheath, the sheath comprising first bearing means for bearing against one of the brake pad supports, the shaft comprising second bearing means for pulling against the other of the brake pad supports in an opposite direction whereby the brake pad supports are drawn together, the other end of the sheath being connected to a handle, the flexible shaft being connected to a lever pivoted on the handle, whereby squeezing the lever toward the handle transfers tension and pressure to the brake pad supports, pulling them and the brake pad supports together against both sides of both wheels.

17. A brake mechanism as defined in claim 16, further including a brake locking mechanism for retaining relative positions of the cable and sheath.

18. A brake mechanism as defined in claim 17 in which the locking mechanism is comprised of a pin extending from either one of the handle or lever, and a hook rotatably pinned to the other of the handle and lever in a position such that when the handle and lever are squeezed together, the hook can be rotated over the pin and retain the handle and lever together.

* * * * *